US006536308B1

(12) United States Patent
Thorne et al.

(10) Patent No.: US 6,536,308 B1
(45) Date of Patent: Mar. 25, 2003

(54) TOOL HAVING AN ATTACHED WORKING SURFACE

(75) Inventors: John K. Thorne, Prescott, AZ (US); Thomas E. Yost, Prescott, AZ (US); Philip M. Maier, Paulden, AZ (US); Mark R. Martinez, Atwater, CA (US)

(73) Assignee: Sturm, Ruger & Company, In., Southport, CT (US)

( * ) Notice: Subject to any disclaimer, the term of this patent is extended or adjusted under 35 U.S.C. 154(b) by 72 days.

(21) Appl. No.: 09/686,312

(22) Filed: Oct. 11, 2000

Related U.S. Application Data

(63) Continuation of application No. 09/476,215, filed on Dec. 30, 1999, now abandoned.

(51) Int. Cl.[7] ..... B25C 1/00
(52) U.S. Cl. ..... 81/20; 81/22
(58) Field of Search ..... 76/103; 81/20, 81/25, 22; 428/660, 609, 684

(56) References Cited

U.S. PATENT DOCUMENTS

| | | | | | |
|---|---|---|---|---|---|
| 974,021 | A | * | 10/1910 | Blake | 81/25 |
| 988,402 | A | * | 4/1911 | Strandberg | 81/25 |
| 2,566,517 | A | | 9/1951 | Dicks | 145/36 |
| 2,776,689 | A | * | 1/1957 | Falzone | 145/29 |
| 3,721,282 | A | * | 3/1973 | Hayes et al. | 145/29 A |
| 3,793,656 | A | * | 2/1974 | Songer et al. | 7/8 |
| 3,942,567 | A | | 3/1976 | Richilano | 145/29 R |
| 4,023,221 | A | * | 5/1977 | Cadman | 7/1 R |
| 4,091,871 | A | | 5/1978 | Chiaramonte et al. | 168/4 |
| 4,139,930 | A | * | 2/1979 | Cox | 145/29 R |
| 4,465,115 | A | | 8/1984 | Palomera | 145/30 |
| 4,876,928 | A | * | 10/1989 | Gaulin | 81/20 |
| 5,024,437 | A | * | 6/1991 | Anderson | 473/342 |
| 5,028,049 | A | * | 7/1991 | McKeighen | 473/345 |
| 5,088,174 | A | | 2/1992 | Hull et al. | 29/254 |
| 5,094,383 | A | * | 3/1992 | Anderson et al. | 164/76.1 |
| 5,141,353 | A | * | 8/1992 | Meredith et al. | 403/267 |
| 5,255,575 | A | * | 10/1993 | Williams | 81/25 |
| 5,359,911 | A | | 11/1994 | Kruesi | 81/431 |
| 5,499,984 | A | * | 3/1996 | Steiner et al. | 606/80 |
| 5,657,541 | A | * | 8/1997 | Hickok et al. | 30/123 |
| 5,766,091 | A | * | 6/1998 | Humphrey et al. | 473/324 |
| 5,817,962 | A | | 10/1998 | Behrenfeld | 84/422.1 |
| 5,863,268 | A | | 1/1999 | Birch | 473/563 |
| 5,879,243 | A | * | 3/1999 | Hackman | 473/342 |
| 5,906,550 | A | | 5/1999 | Kingston | 473/320 |

FOREIGN PATENT DOCUMENTS

| | | | |
|---|---|---|---|
| GB | 2 039 815 A | | 8/1980 |
| JP | 2-95871 | * | 4/1990 |
| JP | 06-205856 | * | 7/1994 |
| JP | 10-314346 | * | 12/1998 |
| JP | 11-004920 | * | 1/1999 |

OTHER PUBLICATIONS

Annalee Yassi; Repetitive strain injuries; The Lancet, vol. 349, Mar. 29, 1997, pp. 943–947, University of Manitoba, Canada.

* cited by examiner

*Primary Examiner*—John J. Zimmerman
(74) *Attorney, Agent, or Firm*—Pennie & Edmonds LLP

(57) ABSTRACT

A tool comprised of two or more components each composed of differing materials with one component being less dense and the other component having working surface characteristics. The first component may be made of a titanium alloy.

26 Claims, 2 Drawing Sheets

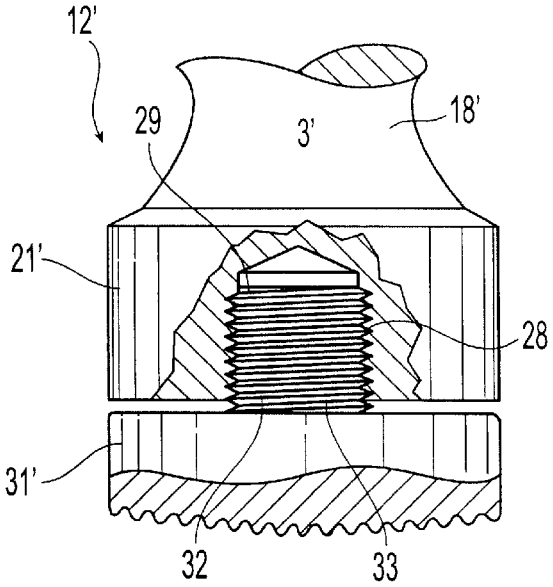
Fig. 4
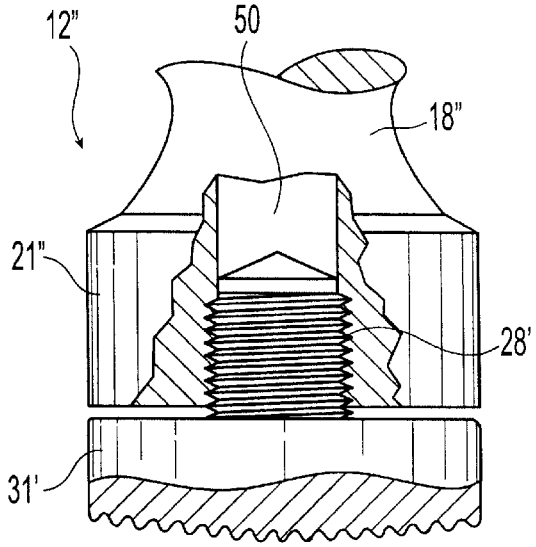
Fig. 4a
Fig. 5
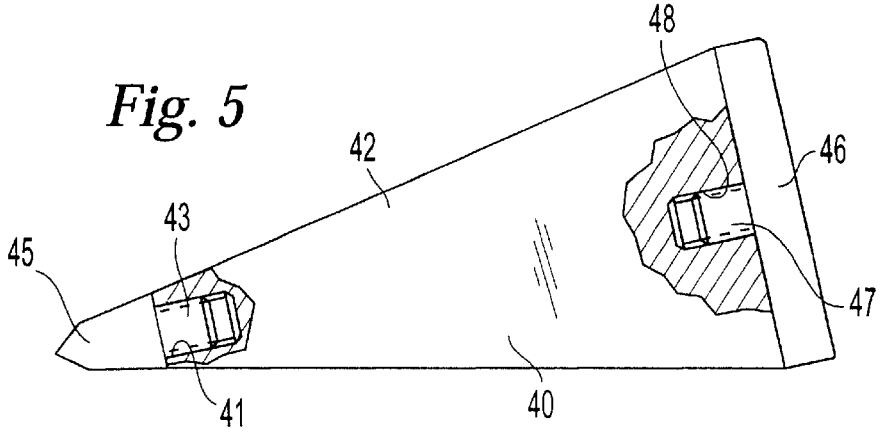

TOOL HAVING AN ATTACHED WORKING SURFACE

This is a continuation of application Ser. No. 09/476,215, filed Dec. 30, 1999, now abandoned.

BACKGROUND OF THE INVENTION

Tools which are swung or otherwise handled by users have weight and hardness characteristics. A tool made in part of a titanium alloy is lighter (has less weight per unit volume) than a tool made of steel since titanium alloys are less dense than steel. Titanium-containing tools require less effort to swing or lift. To accomplish equivalent energy at impact when the tool is used to strike objects, the tool is swung at higher speeds. Hammer heads made of titanium are lighter and easier to swing than steel heads; however, titanium is a softer material than hardened steel causing wear or distortion on and near the nail striking surface. Titanium hammers "mushroom" or otherwise deform at the striking face portion. Further, titanium hammers can create sparks when struck against certain surfaces requiring precautions to be taken.

Other steel or iron tools in use have similar drawbacks in that they are heavy enough to present a problem to users when repeatedly swung or lifted such as wedges used in log splitting and repeatedly placed in metal working mechanisms and then removed.

SUMMARY OF THE INVENTION

Broadly, the present invention comprises a tool or portion of a tool which has a first component that is composed of a material less dense than steel and therefore easier for the user to handle and a second tool component that has characteristics that are harder or otherwise useful as a working tool portion. The components are connected together.

The tool may be a tool that is swung or otherwise manipulated by the user such as a hammer or wedge used in splitting logs or may be a tool placed in and removed from a material working machine which uses tools in which weight reduction is advantageous.

The invention further includes unique arrangements for attaching the tool components together.

BRIEF DESCRIPTION OF THE DRAWINGS

FIG. 4 is a partial elevational view of a further embodiment of the invention in which the working tool portion is threadedly attached to the hammer head;

FIG. 4*a* is still another embodiment similar to FIG. 4 with the lower head portion having a void therein; and FIG. 5 is a side elevational view of a wedge tool of the present invention.

DESCRIPTION OF THE PREFERRED EMBODIMENTS OF THE INVENTION

Figure 1:
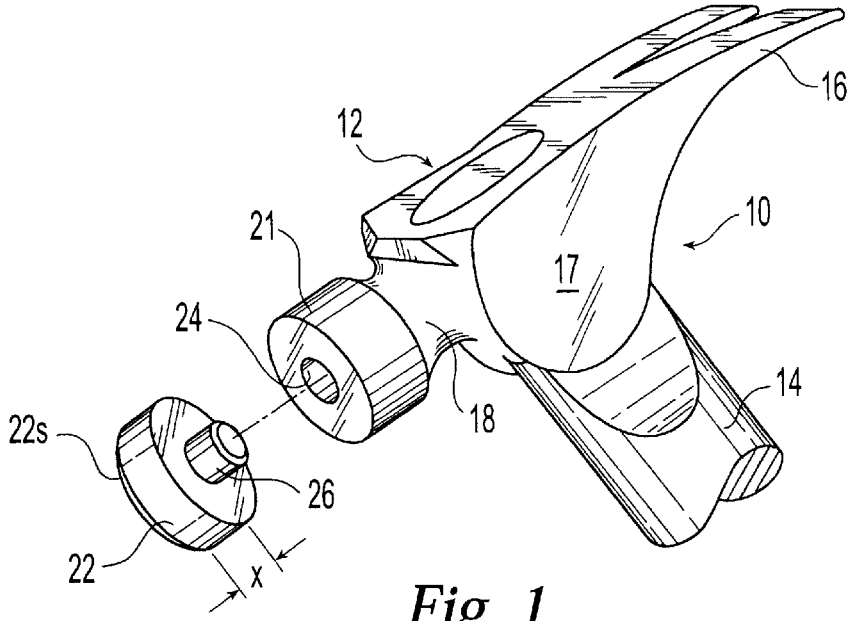
FIG. 1 is a perspective exploded view of a hammer tool including the working portion of the present invention.

In FIG. 1, hammer tool 10 includes head 12 and handle 14. Head 12 includes claw portion 16, upper body portion 17, transition portion 18, lower body portion 21 and striking portion 22. Portions 16, 17, 18 and 21 are made of titanium, a titanium alloy or other material having a density (weight per unit volume) less than steel. The preferred titanium alloy for hammer heads is a high strength alloy such as 90% Ti, 6% aluminum and 4% vanadium. Alternatively, the aluminum content may be in the range of 2.5%–6.75% by weight and the vanadium content in the range of 2%–4.5% by weight. The striking portion 22 is made of hardenable steel such as steel alloy 4140 which is a medium-carbon low alloy steel. Such steel can be readily hardened to substantial depth from the surface and to high hardness levels. Such hardening is accomplished in the practice of the invention to achieve good hammer or other steel characteristics. Fully hardened alloy 4140 has a Rockwell hardness of C54 to 59.

Both the titanium and steel portions are preferably investment cast but other methods of fabrication may be used. Striking portion 22 having thickness t and surface 22*s* do not substantially deform when the tool is used for a substantial period for striking nails or other objects.

Lower body portion 21 has cylindrical recess 24 therein. Striking portion 22 includes cylindrical projection 26 which at room temperature has a diameter of 0.004 inches greater than the diameter of recess 24. When the lower bottom portion 21 is heated to about 1300° F. recess 24 expands so that cylindrical projection 26 can be pressed into recess 24. Upon cooling, a shrink fit connection is formed in which the compressive stress holding cylindrical projection 26 is about 75% of the yield strength of the titanium alloy comprising lower body portion 21. Alternatively, the recess may be in the striking portion in which case the striking portion 22 is thermally expanded or the lower body portion 21 is thermally contracted or both prior to assembly of the two components to accomplish a shrink fit assembly. Further, in accomplishing a shrink fit connection, portion 26 may be cooled below room temperature such as to −100° F. by using dry ice.

Figure 2:
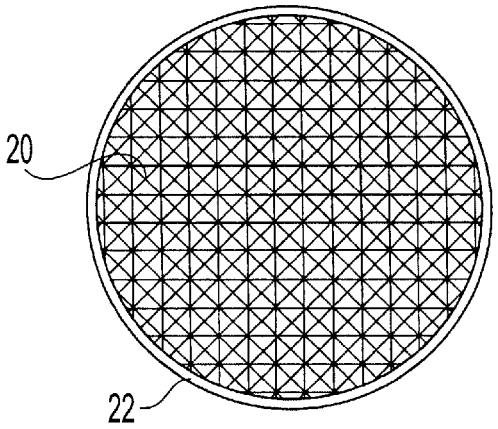
FIG. 2 is a bottom view of the working tool portion of FIG. 3.
Figure 3:
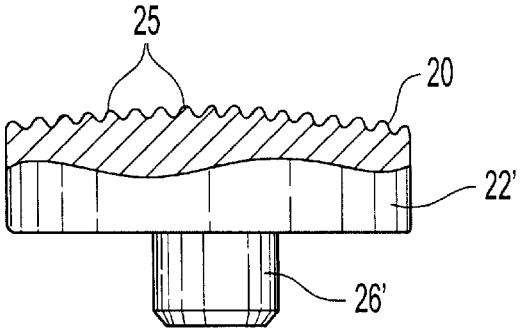
FIG. 3 is an elevational partial sectional view of another embodiment of the working portion of the hammer tool of the present invention.

In FIGS. 2 and 3, an alternative striking portion 22' is shown with knurled working surface 20 including hatched projections 25. Striking portion 22 or its surface 20 may be hardened to improve its ability to withstand high surface-to-surface forces without distortion or mushrooming of the tool striking surface.

Turning to FIG. 4, another embodiment of the hammer tool is shown including transition portion 18', lower head portion 21' which portion 21' has a cylindrical recess 28 with threads 29 around its circumference. Striking portion 31 has cylindrical projection 32 with complementary screw thread portion 33. A thread size ½–20 in which the thread is ½" in diameter and has 20 threads per linear inch is preferred. Prior to threading together head and striking portions 21' and 31, epoxy adhesive is applied to one or more threads 29, 33 Type 5 DP810, DP420, DP105 or DP125 adhesive made by Minnesota Mining and Manufacturing Co. (3M) or other suitable adhesive may be used. A tool striking surface portion for use as a hammer is preferably in the Rockwell C hardness range of 50 to 55, but may be less where the tool forces to be applied are less. A Rockwell hardness of about 40 is satisfactory for some uses.

FIG. 4*a* shows another embodiment including transition portion 18", lower head portion 21", cylindrical recess 28' and striking portion 31'. Cylindrical recess 28' has positioned above it and communicating with it a void 50. Void 50 functions to lower the overall density of the hammer head and optionally adjust the center of gravity of hammer head 12" as described further below.

Finally, FIG. 5 illustrates another embodiment of the invention which is a log-splitting wedge 40 having titanium alloy body 42 including recess 41. Recess 41 receives projection 43 of steel sharpened working tip section 45. Also, steel impact striking portion 46 and projection 47. Recess 41 and tip section 45 and recess 48 and tip section 47 are engaged using the shrink technique described herein or other suitable connector means.

In the manufacture and assembly of a hammer and wedge tools embodiments of the present invention, the titanium hammer head body or wedge body is formed using investment casting techniques. Hammer noses or working wedge ends are fabricated of steel or other high strength, high hardness working material and attached to the titanium head or wedge body, preferably, by shrink fitting. Tool components are fabricated for shrink fitting by forming in one component a recess and in the other component a protrusion. The temperature of the component having the recess is substantially raised, for example, to 1300° F., causing the recess to expand. Thereafter the protrusion is then pressed into the recess and the assembly allowed to cool. As cooling takes place the recess shrinks and engages the protrusion to accomplish an attachment of the two components.

An alternate method of making a hammer head or wedge includes forming the titanium head or wedge portion with a threaded opening. A steel nose or wedge tip section is formed with a mating thread. Adhesive is applied to either or both threads and the nose and head portion are threadedly engaged. Adhesive may be omitted if the threads are designed to deform during assembly to prevent separation during use of the tool.

It is also a feature of the present invention that the center of gravity (center of mass) of the hammer head may be controlled and located by:

1) designing the size, shape and weight of the titanium alloy portion and the size, shape and weight of the steel portion of the hammer head to achieve the desired center of gravity, including
   a) locating a void adjacent the steel portion or at appropriate locations; or
   b) locating a portion of tungsten or other high density material in such void.

Thus, two, three or more materials may be used in the head to achieve the desired center of gravity for most effective hammering, for user-friendly operation and good balance. The center of gravity is the location at a single point of a component for static or dynamic engineering calculations.

The use of two or more components for a tool head provides a method of placing the center of gravity of the head at a selected point so that when the head is swung through an arc using a handle the head has proper balance to provide ease and effectiveness of use. For example, the closer the center of gravity of the head to the working surface, the less torque will be created by off hits (where a portion of working surface striking the object offset from the swing arc which arc includes the head's center of gravity).

Titanium alloy is highly corrosion resistant, and whereas steel alloy 4140 will rust, an improved version for a corrosion resistant assembly is to use a lower body portion comprised of a high strength, high hardness stainless steel such as alloy 440C.

"Connector means" herein means any suitable means such as threaded connectors, welding, brazing, adhesives and shrink fitting. Shrink fitting causes the surface of a first component to be moved away from a second component surface when heated and is urged toward and against such second component surface as the first surface is lowered in temperature causing it to forcefully engage such second surface.

We claim:

1. A hand-held hammer comprising:

an elongated handle having two ends;

a tool head attached to a first handle end, the head comprising titanium or titanium alloy; and the head having a striking surface, the striking surface being harder than the titanium or titanium alloy of the head.

2. A hand-held hammer of claim 1 wherein the striking surface is knurled.

3. A hand-held hammer of claim 1 wherein the striking surface is steel.

4. A hand-held hammer of claim 3 wherein the striking surface is knurled.

5. A hand-held hammer of claim 3 wherein the steel is a hardenable medium-carbon, low-alloy steel.

6. A hand-held hammer of claim 5 wherein the medium-carbon, low-alloy steel is 4140 steel.

7. A hand-held hammer of claim 1 wherein the steel is a stainless steel for corrosion resistance.

8. A hand-held hammer of claim 7 wherein the stainless steel is a high-strength, high-hardness steel.

9. A hand-held hammer of claim 1 wherein the head is made of a titanium alloy comprising titanium, aluminum, and vanadium.

10. A hand-held hammer of claim 9 wherein the aluminum content is in the range of about 2.5%–6.75% and the vanadium content is in the range of about 2%–4.5%.

11. A hand-held hammer of claim 9 wherein the titanium alloy is about 90% titanium, 6% aluminum, and 4% vanadium.

12. A striking tool comprising:

an elongated handle having two ends;

a tool head attached to a first handle end, the head comprising titanium or titanium alloy; and the head having a striking surface, the striking surface being harder than the titanium or titanium alloy of the head;

wherein the striking surface is shrink fit onto the tool head.

13. A striking tool comprising:

an elongated handle having two ends;

a tool head attached to a first handle end, the head comprising titanium or titanium alloy; and the head having a striking surface, the striking surface being harder than the titanium or titanium alloy of the head;

wherein the striking surface is threadably attached to the tool head.

14. A striking tool comprising:

an elongated handle having two ends;

a tool head attached to a first handle end, the head comprising titanium or titanium alloy;

the head having a steel striking surface, the striking surface being harder than the titanium or titanium alloy of the head;

wherein the striking surface has a sharpened working tip.

15. A hand-held hammer of claim 1 further comprising a void in the head for controlling the location of the center of gravity of the head.

16. A striking tool comprising:

an elongated handle having two ends;

a tool attached to a first handle end, the head comprising titanium or titanium alloy;

the head having a steel striking surface, the striking surface being harder than the titanium or titanium alloy of the head;

wherein the striking surface is wedge-shaped; and wherein the striking tool further comprises the head having a void for controlling the location of the center of gravity of the head, the void containing a portion of a high density material.

17. A hand-held hammer comprising:

an elongated handle having two ends;

a tool head attached to a first handle end, the head comprising titanium or titanium alloy; and a striking surface attached to the head, the striking surface being made of a hardenable steel, the striking surface having a hardness of at least about 40 Rockwell C.

18. A hand-held hammer of claim 17 wherein the striking surface has a hardness of about 50 to 59 Rockwell C.

19. A hand-held hammer of claim 17 further comprising the head having a void for controlling the location of the center of gravity of the head.

20. A hand-held hammer of claim 19 wherein the void is located adjacent to the steel striking surface.

21. A striking tool comprising:

an elongated handle having two ends;

a tool head attached to a first handle end, the head comprising titanium or titanium alloy;

a striking surface attached to the head, the striking surface being made of a hardenable steel, the striking surface having a hardness of at least about 40 Rockwell C;

wherein the head has a void for controlling the location of the center of gravity of the head, the void containing a portion of a high density material such as tungsten.

22. A hand-held hammer comprising:

an elongated handle having two ends;

a tool head for striking attached to a first handle end, the head comprising titanium or titanium alloy, the head having a body and a striking portion attached to the body, the striking portion having a striking surface, wherein the striking portion and the striking surface are harder than the titanium or titanium alloy of the head.

23. A hand-held hammer of claim 22 wherein the striking portion and striking surface are made of steel.

24. A hand-held hammer of claim 23 wherein at least the striking surface has a hardness of at least 40 Rockwell C.

25. A hand-held hammer of claim 23 wherein at least the striking surface has a hardness of about 50 to 59 Rockwell C.

26. A hand-held hammer comprising:

an elongated handle having two ends;

a tool head attached to a first handle end, the head comprising titanium or titanium alloy;

the head having a striking surface, the striking surface being harder than the titanium or titanium alloy of the head; and a void in the head for controlling the location of the center of gravity of the head.

* * * * *

UNITED STATES PATENT AND TRADEMARK OFFICE

CERTIFICATE OF CORRECTION

PATENT NO. : 6,536,308 B1
DATED : March 25, 2003
INVENTOR(S) : John K. Thorne et al.

It is certified that error appears in the above-identified patent and that said Letters Patent is hereby corrected as shown below:

Column 4,
Line 19, replace "1" with -- 3 --.

Signed and Sealed this

Eighth Day of July, 2003

JAMES E. ROGAN
*Director of the United States Patent and Trademark Office*